US010132520B2

(12) United States Patent
Yamane et al.

(10) Patent No.: US 10,132,520 B2
(45) Date of Patent: Nov. 20, 2018

(54) AIR CONDITIONING SYSTEM HAVING A MICROCOMPUTER POWERED BY A RELAY

(71) Applicant: DAIKIN INDUSTRIES, LTD., Osaka (JP)

(72) Inventors: Yukihide Yamane, Osaka (JP); Hidehiro Ishii, Minneapolis, MN (US); Yasushi Kurosawa, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 255 days.

(21) Appl. No.: 15/175,770

(22) Filed: Jun. 7, 2016

(65) Prior Publication Data

US 2016/0363338 A1 Dec. 15, 2016

(30) Foreign Application Priority Data

Jun. 10, 2015 (JP) ..... 2015-117619

(51) Int. Cl.

| | |
|---|---|
| ***F24F 11/00*** | (2018.01) |
| ***F24F 11/62*** | (2018.01) |
| ***F24F 11/88*** | (2018.01) |
| ***F24F 11/30*** | (2018.01) |
| *F24F 11/46* | (2018.01) |
| *F24F 11/89* | (2018.01) |
| *F24F 11/50* | (2018.01) |
| *F24F 11/63* | (2018.01) |

(52) U.S. Cl.

CPC ..... *F24F 11/62* (2018.01); *F24F 11/30* (2018.01); *F24F 11/88* (2018.01); *F24F 11/46* (2018.01); *F24F 11/50* (2018.01); *F24F 11/63* (2018.01); *F24F 11/89* (2018.01)

(58) Field of Classification Search

CPC .. F24F 11/00; F24F 11/46; F24F 11/50; F24F 11/63; F24F 11/88; F24F 11/89; G05D 23/19; G05D 23/1917

See application file for complete search history.

(56) References Cited

U.S. PATENT DOCUMENTS 4,898,229 A * 2/1990 Brown ..... G05D 23/19 165/11.1

FOREIGN PATENT DOCUMENTS

JP 2000-111123 A 4/2000

* cited by examiner

*Primary Examiner* — Jonathan Bradford
(74) *Attorney, Agent, or Firm* — Osha Liang LLP

(57) ABSTRACT

An air conditioning system includes a microcomputer unit that controls a utilization-side unit and a heat source-side unit of an air conditioner and a thermostat connected to the air conditioner. The thermostat switches between an ON state in which the thermostat inputs a control signal to the microcomputer unit and an OFF state in which the thermostat does not input the control signal to the microcomputer unit. The system further includes a relay that switches to a feed state in which power is fed to the microcomputer unit or a non-feed state in which power is not fed to the microcomputer unit, and a power-on circuit within or externally attached to the air conditioner. The power-on circuit switches the relay from the power non-feed state to the power feed state using a voltage of the control signal inputted to the microcomputer unit.

13 Claims, 11 Drawing Sheets

AIR CONDITIONING SYSTEM HAVING A MICROCOMPUTER POWERED BY A RELAY

TECHNICAL FIELD

The present invention relates generally to an air conditioning system, and in particular relates to an air conditioning system that can minimize power consumption during operating standby of an air conditioner.

BACKGROUND ART

Separate-type air conditioners popular in the marketplace include, for example, units disclosed in Patent Literature 1 (Japanese Laid-open Patent Application No. 2000-111123). This air conditioner is designed such that signal intercommunication between an indoor controller and an outdoor controller takes place through a signal transmission communication line; the outdoor controller is connected via opening/closing means to a power line inside the outdoor unit, and even when the opening/closing means is open and the outdoor controller is stopped, startup power can be fed from the indoor unit side to the outdoor unit side through the signal transmission communication line. That is, with this configuration, the feed of power to the outdoor unit side during standby is cut off, and standby power is reduced.

On the other hand, with a separate-type air conditioner having a thermostat, an indoor unit, and an outdoor unit, each of the air conditioning modes are controlled by switching the thermostat to either a state of "outputting" or a state of "not outputting" a control signal to the indoor unit and the outdoor unit.

SUMMARY OF THE INVENTION

However, with the method disclosed in the aforementioned Patent Literature 1, power continues to be fed to the indoor unit, and thus a commensurate amount of power is consumed.

In one or more embodiments of the present invention, a low-cost air conditioning system can perform operation of an air conditioner controlled using a thermostat, and when the operation of the air conditioner is not actuated, power consumption by the outdoor unit and the indoor unit can be controlled to a minimum.

An air conditioning system according to one or more embodiments of the present invention may comprise a microcomputer, a thermostat, a relay, and a power-on circuit. The microcomputer controls a utilization-side unit and a heat source-side unit of an air conditioner. The thermostat is connected to the air conditioner, measures the temperature of an air-conditioned space, changes a contact to an ON state or an OFF state according to the measurement result, and switches between input/non-input of a control signal to the microcomputer. The relay switches to either a power feed state in which power is fed to the microcomputer or a power non-feed state in which power is not fed to the microcomputer. The power-on circuit is housed within or externally attached to the air conditioner, and switches the relay from the power non-feed state to the power feed state using a voltage of a control signal inputted to the microcomputer.

With this air conditioning system, even in a state in which the feed of power to the microcomputer which controls the utilization-side unit and the heat source-side unit has been stopped, the relay can be driven by the voltage of a control signal inputted to the microcomputer from the thermostat and power supplied to the microcomputer, and therefore the feed of power to the utilization-side unit and the heat source-side unit can be stopped during standby.

As a result, as compared to a system of conventional type in which only the feed of power to the outdoor unit (heat source-side unit) is stopped while continuing to feed power to the indoor unit (utilization-side unit), power consumption by the air conditioner during standby can be controlled to a minimum.

Moreover, as existing wiring can be used for connections between the thermostat and the air conditioner, cost increases can be minimized.

In one or more embodiments of the air conditioning system, the power-on circuit directly drives the relay using the voltage of a control signal inputted to the microcomputer.

With this air conditioning system, the voltage of the control signal inputted to the microcomputer is used as a driving voltage for the relay, and therefore the configuration of the power-on circuit is simple.

In one or more embodiments of the air conditioning system, the power-on circuit starts up the microcomputer using the voltage of a control signal inputted to the microcomputer, and drives the relay via the microcomputer.

With this air conditioning system, the microcomputer is started up using the voltage of the control signal inputted to the microcomputer, and therefore the configuration of the power-on circuit is simple, and additionally the microcomputer can independently carry out drive control of the relay.

In one or more embodiments of the air conditioning system, the power-on circuit is an externally attached circuit disposed between the thermostat and the air conditioner.

With this air conditioning system, through external attachment of the power-on circuit, even an air conditioner that cannot be adapted to reduced power consumption during standby can be converted to a reduced standby power specification.

In one or more embodiments of the air conditioning system, the relay is connected to a power line of the microcomputer. The power-on circuit has diodes and a capacitor. Anodes of the diodes are connected to control signal communication lines. One lead of the capacitor is connected to cathodes of the diodes, and the other lead of the capacitor is connected to ground. The potential of the capacitor is used as drive voltage for the relay.

With this air conditioning system, the circuit configuration of the power-on circuit employs a diode and a capacitor, and is therefore simple and low-cost.

In one or more embodiments of the air conditioning system, the relay is incorporated into the power-on circuit.

With this air conditioning system, by incorporating the relay into the power-on circuit, it is possible for the power-on circuit to be externally attached with substantially no modification, even to an air conditioner that cannot be adapted to reduced power consumption during standby, so the unit can be converted to a reduced standby power specification in a simple manner.

In one or more embodiments of the air conditioning system, the relay is connected to a power line of the microcomputer. The power-on circuit has diodes and a resistor element. The anodes of the diodes are connected to control signal communication lines. One lead of the resistor element is connected to cathodes of the diodes, and the other lead is connected to the power line, between the relay and the microcomputer.

With this air conditioning system, the circuit configuration of the power-on circuit employs a diode and a resistor element, and is therefore simple and low-cost.

With the air conditioning system according to one or more embodiments of the present invention, even in a state in which the feed of power to the microcomputer which controls the utilization-side unit and the heat source-side unit has been stopped, the relay can be driven by the voltage of a control signal inputted to the microcomputer from the thermostat and power supplied to the microcomputer, and therefore the feed of power to the utilization-side unit and the heat source-side unit can be stopped during standby.

As a result, as compared to a system of conventional type in which only the feed of power to the outdoor unit (heat source-side unit) is stopped while continuing to feed power to the indoor unit (utilization-side unit), power consumption by the air conditioner during standby can be controlled to a minimum.

Moreover, as existing wiring can be used for connections between the thermostat and the air conditioner, cost increases can be minimized.

With the air conditioning system according to one or more embodiments of the present invention, the voltage of the control signal inputted to the microcomputer is used as a driving voltage for the relay, and therefore the configuration of the power-on circuit is simple.

With the air conditioning system according to one or more embodiments of the present invention, the microcomputer is started up using the voltage of the control signal inputted to the microcomputer, and therefore the configuration of the power-on circuit is simple, and additionally the microcomputer can independently carry out drive control of the relay.

With the air conditioning system according to one or more embodiments of the present invention, through external attachment of the power-on circuit, even an air conditioner that cannot be adapted to reduce power consumption during standby can be converted to a reduced standby power specification.

With the air conditioning system according to one or more embodiments of the present invention, the circuit configuration of the power-on circuit employs a diode and a capacitor, and is therefore simple and low-cost.

With the air conditioning system according to one or more embodiments of the present invention, by incorporating the relay into the power-on circuit, it is possible for the power-on circuit to be externally attached with substantially no modification, even to an air conditioner that cannot be adapted to reduced power consumption during standby, and the unit can be converted to a reduced standby power specification in a simple manner.

In the air conditioning system according to one or more embodiments of the present invention, the circuit configuration of the power-on circuit employs a diode and a resistor element, and is therefore simple and low-cost.

DETAILED DESCRIPTION OF EMBODIMENTS

Embodiments of the present invention will be described below, while making reference to the drawings. The embodiments below are merely specific examples of the present invention, and do not limit the technical scope of the present invention.

First Example (1) Overview of Air Conditioning System 100

Figure 1:
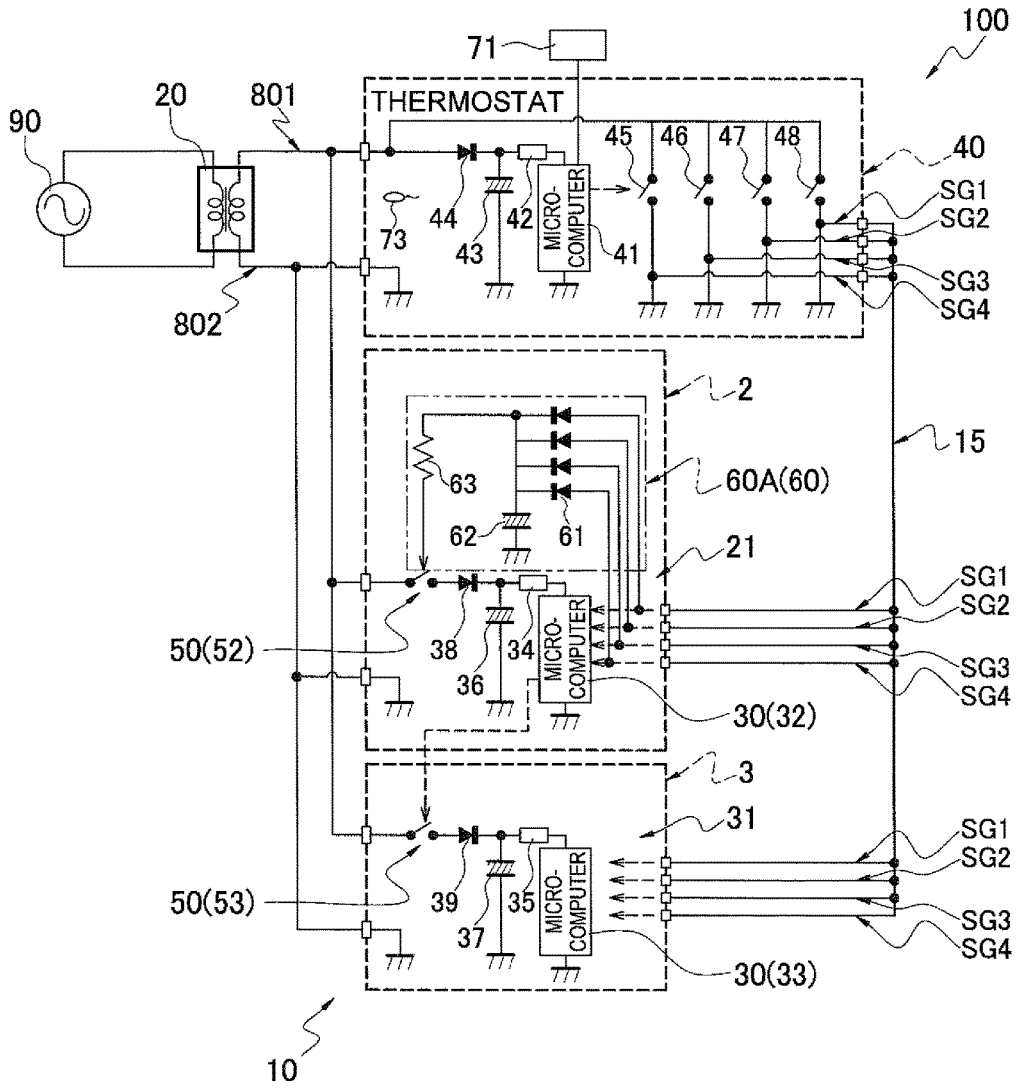
FIG. 1 is a block diagram showing a state of electrical connections of an air conditioner and a thermostat in an air conditioning system according to one or more embodiments of the present invention.

FIG. 1 is a block diagram showing a state of electrical connections of an air conditioner 10 and a thermostat 40 in an air conditioning system 100 according to one or more embodiments of the first example of the present invention. In FIG. 1, the air conditioner 10 may comprise an indoor unit 2 installed inside a building, and an outdoor unit 3 installed outside the building.

The thermostat 40 is mounted in the same indoor space as the indoor unit 2. The thermostat 40 is connected via a communication line to respective control systems of the indoor unit 2 and the outdoor unit 3.

A transformer 20 transforms a commercial power supply 90 voltage to a usable low voltage, which is then fed respectively to the indoor unit 2, the outdoor unit 3, and the thermostat 40 via power supply lines 801, 802.

(2) Air Conditioner 10

The air conditioner 10 is a refrigerating device that utilizes a vapor compression refrigerating cycle, and is connected by refrigerant interconnection pipes (not illustrated) to the indoor unit 2 which is the utilization side, and to the outdoor unit 3 which is the heat source side.

(2-1) Indoor Unit 2

The indoor unit 2 is provided on-board with an indoor-side control board 21. The indoor-side control board 21 has an indoor-side microcomputer 32, an indoor-side switching power supply 34, an indoor-side capacitor 36, an indoor-side diode 38, an indoor-side relay 52, and a power-on circuit 60A.

(2-1-1) Indoor-Side Microcomputer 32

The indoor-side microcomputer 32 controls the operation of the air conditioner 10 while exchanging communications with an outdoor-side microcomputer 33. To the indoor-side microcomputer 32, a plurality of command signals from the thermostat 40 are input to respectively different input ports via communication lines 15. For convenience, the communication lines 15 from the thermostat 40 are depicted as a single thick line representing a cable of a plurality of bundled communication lines.

In the present embodiment, the indoor-side microcomputer 32 is connected to at least a fan operation command communication line SG1, a cooling operation command communication line SG2, a heating operation command communication line SG3, and another operation command communication line SG4, from the thermostat 40.

Because 24 V AC is applied to each of the communication lines, a converter, not illustrated, has been connected on each of the communication lines corresponding to each of the input ports of the indoor-side microcomputer 32, and a DC signal is input to each input port of the indoor-side microcomputer 32.

(2-1-2) Indoor-Side Switching Power Supply 34

The indoor-side switching power supply 34 intervenes between the indoor-side relay 52 and the indoor-side microcomputer 32, and converts alternating current power fed via the indoor-side relay 52 to direct current power.

(2-1-3) Indoor-Side Capacitor 36

The indoor-side capacitor 36 is a bypass capacitor connected between ground GND and a power supply line linking the indoor-side relay 52 and the indoor-side switching power supply 34, and maintains the fed potential to the indoor-side switching power supply 34.

(2-1-4) Indoor-Side Diode 38

The indoor-side diode 38 is connected on the power supply line linking the indoor-side relay 52 and the indoor-side switching power supply 34, at a location between the connection point of the positive pole of the indoor-side capacitor 36 and the indoor-side relay 52. The cathode of the indoor-side diode 38 is connected to the positive pole side of the indoor-side capacitor 36, and the anode to the indoor-side relay 52. The indoor-side diode 38 prevents a charge stored in the indoor-side capacitor 36 from flowing to the indoor-side relay 52 when discharged.

(2-1-5) Indoor-Side Relay 52

The indoor-side relay 52 brings in power from the power supply lines 801, 802. The indoor-side relay 52 may be of mechanical contact type or electronic contactless type; when ON, the indoor-side relay 52 enters a power feed state in which power is fed to the indoor-side microcomputer 32, and when OFF, enters a power non-feed state in which power is not fed to the indoor-side microcomputer 32.

(2-1-6) Power-on Circuit 60A

The power-on circuit 60A feeds a drive voltage to the indoor-side relay 52. The power-on circuit 60A has a plurality of diodes 61, a capacitor 62, and a resistor element 63.

The quantity of the diodes 61 coincides with the quantity of the operation command communication lines connected to the indoor-side microcomputer 32, and the anode sides thereof are connected to any of the plurality of communication lines.

In the present embodiment, the anodes of the diodes 61 are respectively connected to the communication lines of the fan operation command communication line SG1, the cooling operation command communication line SG2, the heating operation command communication line SG3, and the other operation command communication line SG4.

The capacitor 62 is connected between ground GND and the cathodes of the diodes 61, in order to maintain and stabilize the potential at the cathodes of the diodes 61.

One lead of the resistor element 63 is connected to the cathodes of the diodes 61, and the other lead is connected to a drive coil (not illustrated) of the indoor-side relay 52. The resistor element 63 brings down the applied voltage to a voltage suitable for driving the indoor-side relay 52.

The power-on circuit is not limited to this arrangement, and therefore in some cases hereinbelow, symbols combining "60" and an "alphanumeric character" are assigned to a power-on circuit appearing in text; such circuits, when referred to collectively, are denoted as the "power-on circuit 60."

(2-2) Outdoor Unit 3

The outdoor unit 3 is provided on-board with an outdoor-side control board 31. The outdoor-side control board 31 has an outdoor-side microcomputer 33, an outdoor-side switching power supply 35, an outdoor-side capacitor 37, an outdoor-side diode 39, and an outdoor-side relay 53.

(2-2-1) Outdoor-Side Microcomputer 33

The outdoor-side microcomputer 33 controls the operation of the air conditioner 10 while exchanging communications with the indoor-side microcomputer 32. To the outdoor-side microcomputer 33, a plurality of command signals from the thermostat 40 are input to respectively different input ports via communication lines 15, analogously to the indoor-side microcomputer 32.

For example, the outdoor-side microcomputer 33 is connected to at least the fan operation command communication line SG1, the cooling operation command communication line SG2, the heating operation command communication line SG3, and another operation command communication line SG4, from the thermostat 40.

Because 24 V AC is applied to each of the communication lines, a converter, not illustrated, has been connected on each of the communication lines corresponding to each of the input ports of the outdoor-side microcomputer 33, and a DC signal is input to each input port of the outdoor-side microcomputer 33.

In the figures, the indoor-side microcomputer 32 and the outdoor-side microcomputer 33 are referred to collectively as a "microcomputer 30." In one or more embodiments, the indoor-side microcomputer and the outdoor-side microcomputer may be referred collectively as a "microcomputer unit."

(2-2-2) Outdoor-Side Switching Power Supply 35

The outdoor-side switching power supply 35 intervenes between the outdoor-side relay 53 and the outdoor-side microcomputer 33, and converts alternating current power fed via the outdoor-side relay 53 to direct current power.

(2-2-3) Outdoor-Side Capacitor 37

The outdoor-side capacitor 37 is a bypass capacitor connected between ground GND and a power supply line linking the outdoor-side relay 53 and the outdoor-side switching power supply 35, and maintains the fed potential to the outdoor-side switching power supply 35.

(2-2-4) Outdoor-Side Diode 39

The outdoor-side diode 39 is connected on the power supply line linking the outdoor-side relay 53 and the outdoor-side switching power supply 35, at a location between the connection point of the positive pole of the outdoor-side capacitor 37 and the outdoor-side relay 53. The cathode of the outdoor-side diode 39 is connected to the positive pole side of the outdoor-side capacitor 37, and the anode to the outdoor-side relay 53. The outdoor-side diode 39 prevents a charge stored in the outdoor-side capacitor 37 from flowing to the outdoor-side relay 53 when discharged.

(2-2-5) Outdoor-Side Relay 53

The outdoor-side relay 53 brings in power from the power supply lines 801, 802. The outdoor-side relay 53 may be of either mechanical contact type or electronic contactless type; when ON, the outdoor-side relay 53 enters a power feed state in which power is fed to the outdoor-side microcomputer 33, and when OFF, enters a power non-feed state in which power is not fed to the outdoor-side microcomputer 33.

The outdoor-side relay 53 goes ON and enters the power feed state when fed a drive voltage from the indoor-side microcomputer 32.

The indoor-side relay 52, the outdoor-side relay 53, and an externally attached relay 51, discussed below, are collectively referred to as "relays 50."

(3) Thermostat 40

The thermostat 40 is connected to the indoor-side microcomputer 32 of the indoor unit 2 and to the outdoor-side microcomputer 33 of the outdoor unit 3 via the communication line 15. The thermostat 40 is installed in the air-conditioned space in which the indoor unit 2 is installed.

The thermostat 40 has a temperature-control microcomputer 41, a temperature-control switching power supply 42, a temperature-control capacitor 43, a temperature-control diode 44, a fan operation relay 45, a cooling operation relay 46, a heating operation relay 47, and another operation relay 48.

(3-1) Temperature-Control Microcomputer 41

The temperature-control microcomputer 41 determines whether, for example, the difference between an indoor set temperature Ts set by setting means 71 and an indoor temperature Tr detected by a temperature sensor 73 falls within a predetermined range, and when determined to fall outside the predetermined temperature range, turns on the cooling operation relay 46 or the heating operation relay 47, and outputs an operation command signal (or a control signal) to the air conditioner 10. The relay may be of either mechanical contact type or electronic contactless type.

(3-2) Temperature-Control Switching Power Supply 42

The temperature-control switching power supply 42 is interposed between the transformer 20 and the temperature-control microcomputer 41, and converts alternating current power fed from the transformer 20 to direct current power.

(3-3) Temperature-Control Capacitor 43

The temperature-control capacitor 43 is a bypass capacitor connected between ground GND and a power supply line linking the transformer 20 and the temperature-control switching power supply 42, and maintains the fed potential to the temperature-control switching power supply 42.

(3-4) Temperature-Control Diode 44

The temperature-control diode 44 is connected on the power supply line linking the transformer 20 and the temperature-control switching power supply 42, at a location between the connection point of the positive pole of the temperature-control capacitor 43 and the transformer 20. The cathode of the temperature control diode 44 is connected to the positive pole side of the temperature-control capacitor 43, and the anode to the transformer 20. The temperature control diode 44 prevents a charge stored in the temperature-control capacitor 43 from flowing to the transformer 20 side when discharged.

(3-5) Fan Operation Relay 45

When a user from the setting means 71 has selected the fan operation mode, the fan operation relay 45 receives a drive voltage from the temperature-control microcomputer 41, turns ON, and applies 24 V AC to the fan operation command communication line SG1.

(3-6) Cooling Operation Relay 46

When a user from the setting means 71 has selected the cooling operation mode, and the temperature-control microcomputer 41 has determined that the indoor temperature Tr detected by the temperature sensor 73 is higher than the indoor set temperature Ts set from the setting means 71 by the user, the temperature-control microcomputer 41 applies a drive voltage to a drive coil of the cooling operation relay 46.

The cooling operation relay 46 receives the drive voltage from the temperature-control microcomputer 41, turns ON, and applies 24 V AC to the cooling operation command communication line SG2.

(3-7) Heating Operation Relay 47

When a user from the setting means 71 has selected the heating operation mode, and the temperature-control microcomputer 41 has determined that the indoor temperature Tr detected by the temperature sensor 73 is lower than the indoor set temperature Ts set from the setting means 71 by the user, the temperature-control microcomputer 41 applies a drive voltage to a drive coil of the heating operation relay 47.

The heating operation relay 47 receives the drive voltage from the temperature-control microcomputer 41, turns ON, and applies 24 V AC to the heating operation command communication line SG3.

(3-8) Setting Means 71

The setting means 71 has at least an operation mode selection unit (not illustrated) and an indoor temperature setting unit (not illustrated). The operating mode selection unit has a configuration by which, for example, the fan operation mode, the cooling operation mode, or the heating operation mode is chosen using a Select button. The indoor temperature setting function may be, for example, a button type or dial type configuration for increasing or decreasing the set temperature.

(4) Action of Air Conditioning System 100

Figure 2A:
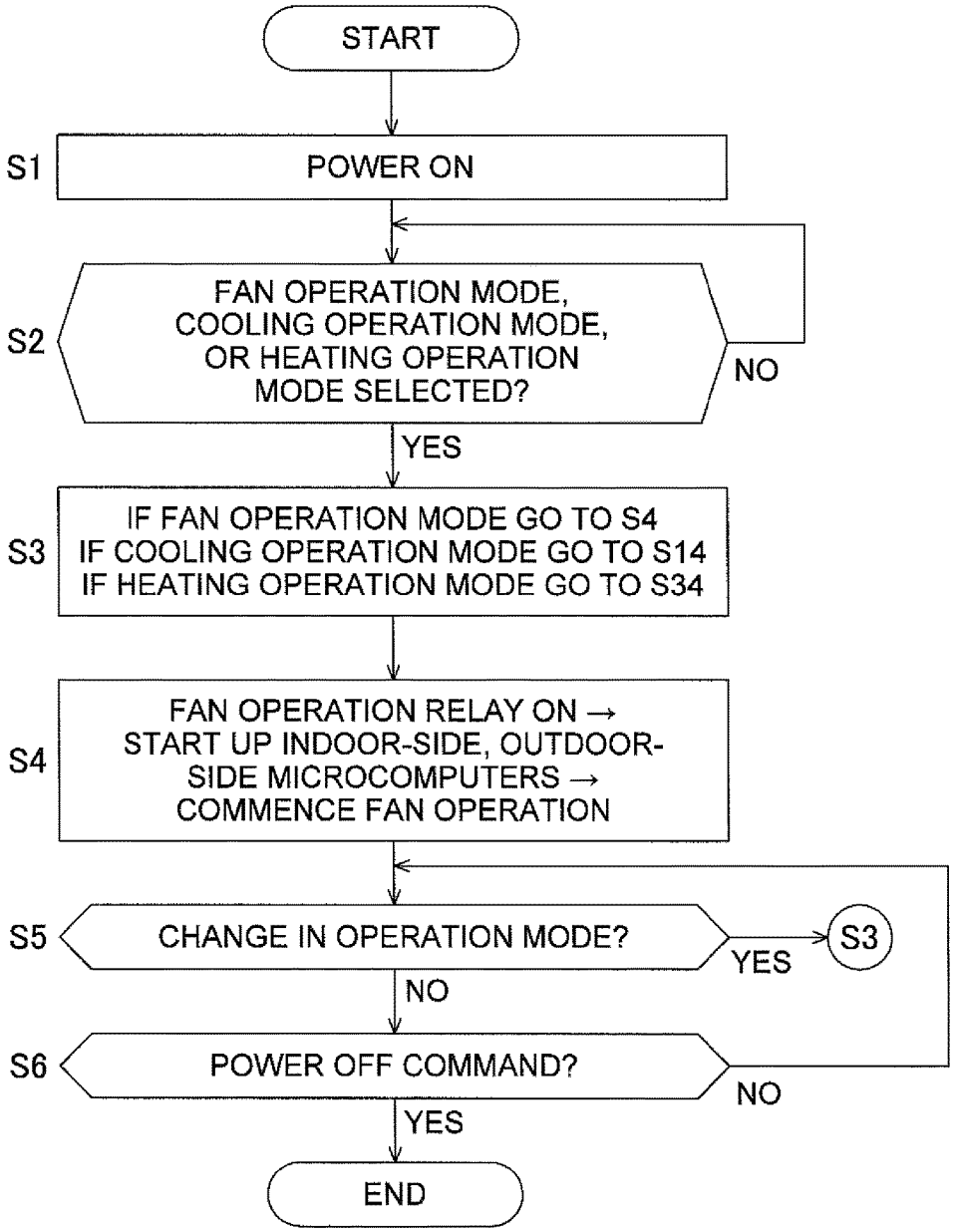
FIG. 2A is a control flowchart of the air conditioning system according to one or more embodiments of the present invention.
Figure 2B:
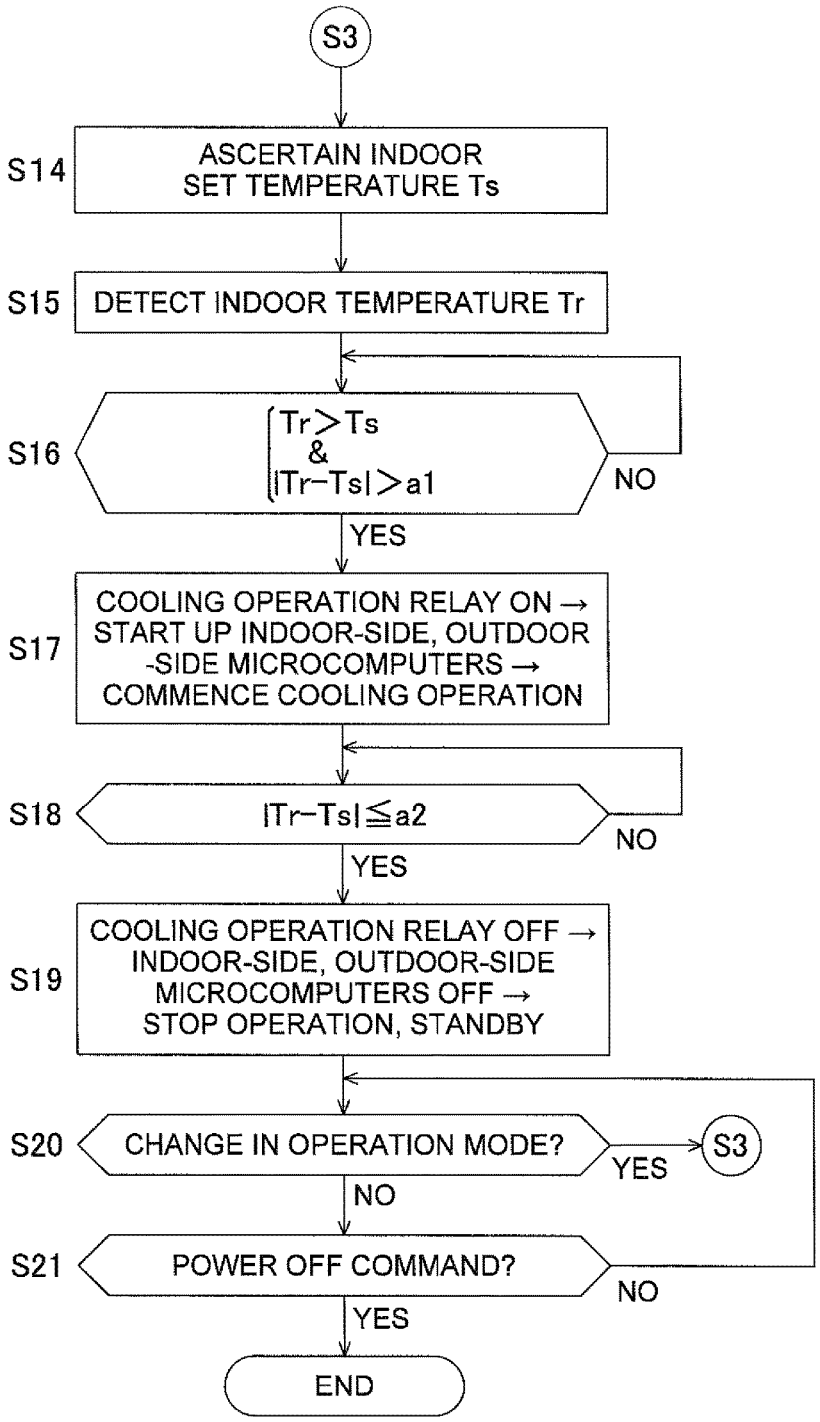
FIG. 2B is a control flowchart of the air conditioning system according to one or more embodiments of the present invention, after cooling operation mode has been selected.
Figure 2C:
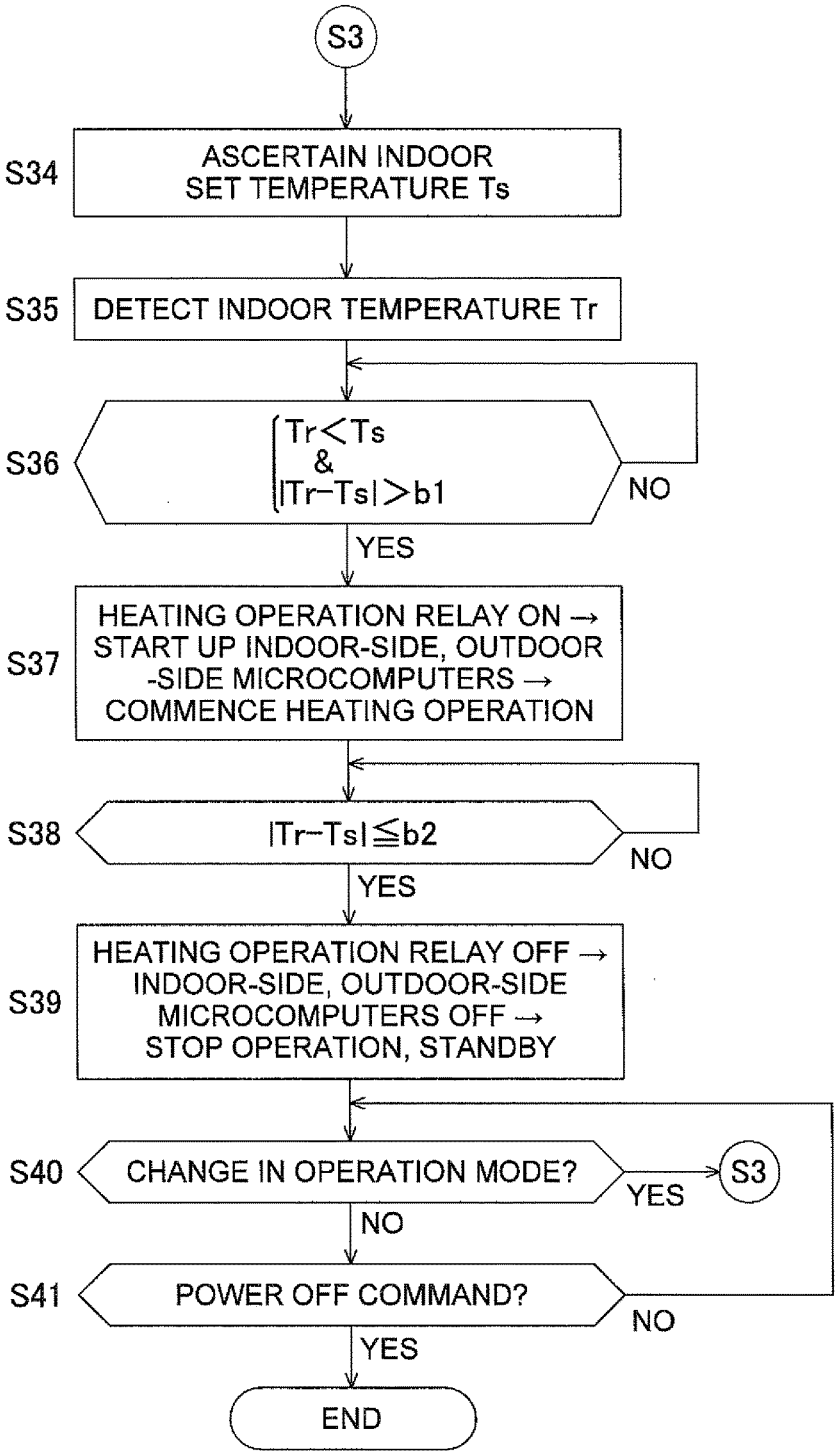
FIG. 2C is a control flowchart of the air conditioning system according to one or more embodiments of the present invention, after heating operation mode has been selected.

The action of the air conditioning system 100 is described below, while referring to control flowcharts. FIG. 2A is a control flowchart of the air conditioning system 100 according to one or more embodiments of the present invention. FIG. 2B is a control flowchart of the air conditioning system 100 according to one or more embodiments of the present invention, after cooling operation mode has been selected. FIG. 2C is a control flowchart of the air conditioning system 100 according to one or more embodiments of the present invention, after heating operation mode has been selected.

When the power supply is turned ON in Step S1, the temperature-control microcomputer 41 advances to Step S2, and determines whether an operation mode has been selected. For convenience, the "other" operation mode is omitted from Step S2 in FIG. 2A.

Next, in Step S3, the temperature-control microcomputer 41 chooses a routine to advance in each of the operation modes. Here, when determined that the operation mode is the fan operation mode, the temperature-control microcomputer 41 advances to Step S4, when determined that the operation mode is the cooling operation mode, advances to Step S14, or when determined that the operation mode is the heating operation mode, advances to Step S34.

(4-1) Case of Fan Operation

In step S4, the temperature-control microcomputer 41 turns on the fan operation relay 45. As a result, 24 V AC is applied to the fan operation command communication line SG1.

At this time, the 24 V AC is fed, via the fan operation command communication line SG1, to the power-on circuit 60A of the indoor-side control board 21 as well, and a drive voltage is fed to the drive coil of the indoor-side relay 52.

Due to the indoor-side relay 52 turning ON, the power fed from the transformer 20 is fed to the indoor-side switching power supply 34, and the indoor-side microcomputer 32 starts up.

The indoor-side microcomputer 32 feeds a drive voltage to the drive coil of the outdoor-side relay 53, turning ON the outdoor-side relay 53.

Due to the outdoor-side relay 53 turning ON, the power fed from the transformer 20 is fed to the outdoor-side switching power supply 35, and the outdoor-side microcomputer 33 starts up.

Due to starting up of at least the indoor-side microcomputer 32, the indoor-side microcomputer 32 runs an indoor fan (not illustrated) of the indoor unit 2, and a fan operation is carried out.

In the above manner, even when the air conditioner 10 stops the feed of power to the indoor-side microcomputer 32 and the outdoor-side microcomputer 33 in order to minimize power consumption during standby, the indoor-side microcomputer 32 can be started up using voltage applied to the operation command communication line by the thermostat 40.

Next, in Step S5, the temperature-control microcomputer 41 determines whether there has been a change in operation mode, and when a determination of "change of operation mode: Yes" is made, returns to Step S3, or when a determination of "change of operation mode: No" is made, advances to Step S6.

Next, in Step S6, the temperature-control microcomputer 41 determines whether there has been a power OFF command, and when a determination of "no power OFF command" is made, returns to Step S5, or when a determination of "power OFF command" is made, terminates control.

(4-2) Case of Cooling Operation

In a case in which the cooling operation mode has been selected, the temperature-control microcomputer 41 in Step 14 ascertains the indoor set temperature Ts, and advances to Step S15.

Next, in Step S15, the temperature-control microcomputer 41 detects the indoor temperature Tr, and advances to Step S16.

Next, in Step S16, the temperature-control microcomputer 41 determines whether the indoor temperature Tr is higher than the indoor set temperature Ts, and whether the absolute value of the difference of the indoor temperature Tr and the indoor set temperature Ts is greater than a predetermined threshold value a1, and in cases in which the aforementioned conditions are met, advances to Step S17, or when the aforementioned conditions are not met, continues with follow-up determination.

Next, the temperature-control microcomputer 41 in Step S17 turns ON the cooling operation relay 46, As a result, 24 V AC is applied to the cooling operation command communication line SG2.

At this time, the 24 V AC is fed, via the cooling operation command communication line SG2, to the power-on circuit 60A of the indoor-side control board 21 as well, and a drive voltage is fed to the drive coil of the indoor-side relay 52.

Due to the indoor-side relay 52 turning ON, the power fed from the transformer 20 is fed to the indoor-side switching power supply 34, and the indoor-side microcomputer 32 starts up.

The indoor-side microcomputer 32 then feeds a drive voltage to the drive coil of the outdoor-side relay 53, turning ON the outdoor-side relay 53.

Due to the outdoor-side relay 53 turning ON, the power fed from the transformer 20 is fed to the outdoor-side switching power supply 35, and the outdoor-side microcomputer 33 starts up.

The cooling operation of the air conditioner 10 is carried out while the indoor-side microcomputer 32 and the outdoor-side microcomputer 33 exchange communication with one another.

Thus, even when the air conditioner 10 stops the feed of power to the indoor-side microcomputer 32 and the outdoor-side microcomputer 33 in order to minimize power consumption during standby, the indoor-side microcomputer 32 can be started up using voltage applied to the cooling operation command communication line SG2 by the thermostat 40.

Next, in Step S18, the temperature-control microcomputer 41 determines whether the absolute value of the difference of the indoor temperature Tr and the indoor set temperature Ts is equal to or less than a predetermined threshold value a2, and when determined that $|Tr-Ts| \leq a2$, advances to Step S19, or when determined that $|Tr-Ts| > a2$, continues temperature monitoring for the purpose of follow-up determination. The relationship $a1 > a2$ exists between the threshold value a1 and the threshold value a2.

Next, in Step S19, the temperature-control microcomputer 41 infers from the result in Step S17 that $|Tr-Ts| \leq a2$ that the indoor temperature Tr has reached the indoor set temperature Ts, and turns OFF the cooling operation relay 46.

As a result, 24 V AC ceases to be applied to the cooling operation command communication line SG2, 24 V AC is no longer fed to the power-on circuit 60A of the indoor-side control board 21, the voltage feed to the drive coil of the indoor-side relay 52 stops, and the indoor-side relay 52 turns OFF.

Due to the indoor-side relay 52 turning OFF, the power fed from the transformer 20 is no longer fed to the indoor-side switching power supply 34, and the indoor-side microcomputer 32 stops. For this reason, the voltage feed to the drive coil of the outdoor-side relay 53 from the indoor-side microcomputer 32 stops, and the outdoor-side relay 53 turns OFF.

Due to the outdoor-side relay 53 turning OFF, the power fed from the transformer 20 is no longer fed to the outdoor-side switching power supply 35, and the outdoor-side microcomputer 33 stops as well. The indoor-side microcomputer 32 and the outdoor-side microcomputer 33 then enter a standby state.

Next, in Step S20, the temperature-control microcomputer 41 determines whether there has been a change in operation mode, and when a determination of "change of operation mode: Yes" is made, returns to Step S3, or when a determination of "change of operation mode: No" is made, advances to Step S21.

Next, in Step S21, the temperature-control microcomputer 41 determines whether or not there is a power OFF command, and in the event of a determination of "power OFF command: No," returns to Step S20, or in the event of a determination of "power OFF command: Yes," terminates control.

(4-3) Heating Operation

In a case in which the heating operation mode has been selected, the temperature-control microcomputer 41 in Step 34 ascertains the indoor set temperature Ts, and advances to Step S35.

Next, in Step S35, the temperature-control microcomputer 41 detects the indoor temperature Tr, and advances to Step S36.

Next, in Step S36, the temperature-control microcomputer 41 determines whether the indoor temperature Tr is lower than the indoor set temperature Ts, and whether the absolute value of the difference of the indoor temperature Tr and the indoor set temperature Ts is greater than a predetermined threshold value b1, and in cases in which the aforementioned conditions are met, advances to Step S37, or when the aforementioned conditions are not met, continues with follow-up determination.

Next, the temperature-control microcomputer 41 in Step S37 turns ON the heating operation relay 47. As a result, 24 V AC is applied to the heating operation command communication line SG3.

At this time, the 24 V AC is fed, via the heating operation command communication line SG3, to the power-on circuit 60A of the indoor-side control board 21 as well, and a drive voltage is fed to the drive coil of the indoor-side relay 52.

Due to the indoor-side relay 52 turning ON, the power fed from the transformer 20 is fed to the indoor-side switching power supply 34, and the indoor-side microcomputer 32 starts up.

Next, the indoor-side microcomputer 32 feeds a drive voltage to the drive coil of the outdoor-side relay 53, turning ON the outdoor-side relay 53.

Due to the outdoor-side relay 53 turning ON, the power fed from the transformer 20 is fed to the outdoor-side switching power supply 35, and the outdoor-side microcomputer 33 starts up.

The heating operation of the air conditioner 10 is carried out while the indoor-side microcomputer 32 and the outdoor-side microcomputer 33 exchange communication with one another.

Thus, even when the air conditioner 10 stops the feed of power to the indoor-side microcomputer 32 and the outdoor-side microcomputer 33 in order to minimize power consumption during standby, the indoor-side microcomputer 32 can be started up using voltage applied to the heating operation command communication line SG3 by the thermostat 40.

Next, in Step S38, the temperature-control microcomputer 41 determines whether the absolute value of the difference of the indoor temperature Tr and the indoor set temperature Ts is equal to or less than a predetermined threshold value b2, and when determined that $|Tr-Ts| \leq b2$, advances to Step S39, or when determined that $|Tr-Ts| > b2$, continues temperature monitoring for the purpose of follow-up determination. The relationship $b1 > b2$ exists between the threshold value b1 and the threshold value b2.

Next, in Step S39, the temperature-control microcomputer 41 infers from the result in Step S37 that $|Tr-Ts| \leq b2$ that the indoor temperature Tr has reached the indoor set temperature Ts, and turns OFF the heating operation relay 47.

As a result, 24 V AC ceases to be applied to the heating operation command communication line SG3, 24 V AC is no longer fed to the power-on circuit 60A of the indoor-side control board 21, the voltage feed to the drive coil of the indoor-side relay 52 stops, and the indoor-side relay 52 turns OFF.

Due to the indoor-side relay 52 turning OFF, the power fed thereto from the transformer 20 is no longer fed to the indoor-side switching power supply 34, and the indoor-side microcomputer 32 stops. For this reason, the voltage feed to the drive coil of the outdoor-side relay 53 from the indoor-side microcomputer 32 stops, and the outdoor-side relay 53 turns OFF.

Due to the outdoor-side relay 53 turning OFF, the power fed from the transformer 20 is no longer fed to the outdoor-side switching power supply 35, and the outdoor-side microcomputer 33 stops as well. The indoor-side microcomputer 32 and the outdoor-side microcomputer 33 then enter a standby state.

Next, in Step S40, the temperature-control microcomputer 41 determines whether there has been a change in operation mode, and when a determination of "change of operation mode: Yes" is made, returns to Step S3, or when a determination of "change of operation mode: No" is made, advances to Step S41.

Next, in Step S41, the temperature-control microcomputer 41 determines whether or not there is a power OFF command, and in the event of a determination of "power OFF command: No," returns to Step S40, or in the event of a determination of "power OFF command: Yes," terminates control.

(5) Characteristics of First Example (5-1)

In this air conditioning system 100, even in a state in which the feed of power to the indoor-side microcomputer 32 and the outdoor-side microcomputer 33 has been stopped, the power-on circuit 60A, utilizing the voltage of the control signal of the thermostat 40, can drive the indoor-side relay 52, and start up the indoor-side microcomputer 32 and the outdoor-side microcomputer 33. As a result, the feed of power to the indoor unit 2 and the outdoor unit 3 can be stopped during standby, and the power consumed by the air conditioner during standby can be kept to a minimum, as compared to a system of conventional type.

Moreover, as existing wiring can be used for connections between the thermostat 40 and the air conditioner 10, cost increases can be minimized.

(5-2)

In this air conditioning system 100, the power-on circuit 60A has the plurality of diodes 61, the capacitor 62, and the resistor element 63. The capacitor 62 maintains and stabilizes the potential at the cathodes of the diodes 61. The resistor element 63 reduces the applied voltage to a voltage suitable for driving the indoor-side relay 52, and feeds the voltage to the indoor-side relay 52. This circuit configuration is simple, and therefore low in cost.

(6) Modifications

A number of various modes may be provided by way of the basic form of the power-on circuit 60A in the embodiments of the first example, by varying the quantity and arrangement thereof.

(6-1) First Modification

In one or more embodiments of the first example, after the indoor-side relay 52, driven by the power-on circuit 60A, has started up the indoor-side microcomputer 32, the outdoor-side relay 53 is driven by the indoor-side microcomputer 32, and the outdoor-side microcomputer 33 is started up; however, it would also be acceptable for the indoor-side relay 52 and the outdoor-side relay 53 to be respectively driven by separate power-on circuits.

Figure 3:
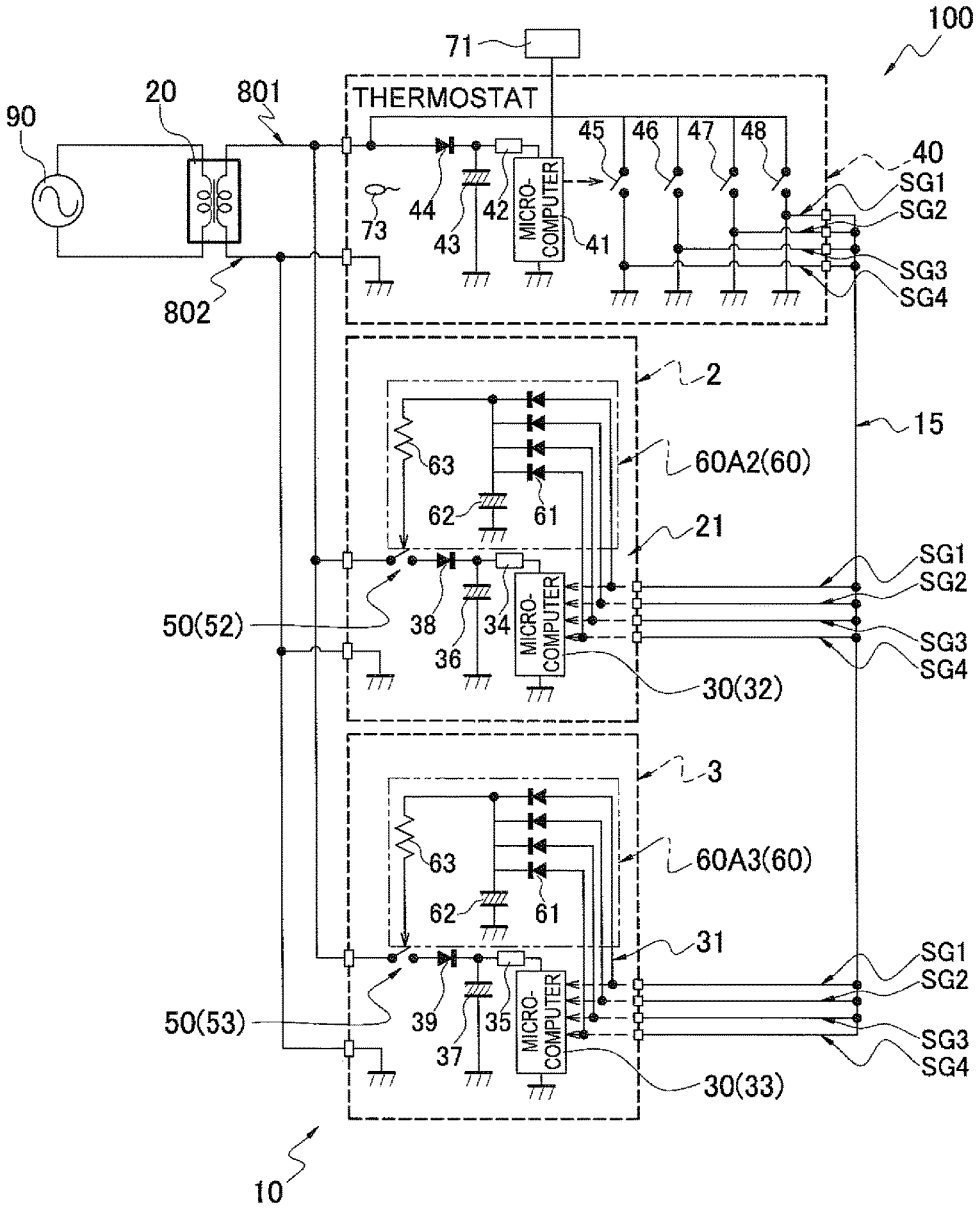
FIG. 3 is a block diagram showing a state of electrical connections of an air conditioner and a thermostat in an air conditioning system according to one or more embodiments of the present invention.

FIG. 3 is a block diagram showing a state of electrical connections of the air conditioner 10 and the thermostat 40 in an air conditioning system 100 according to one or more embodiments of the first example of the present invention. In FIG. 3, the indoor unit 2 is provided on-board with an indoor-side power-on circuit 60A2 for feeding a drive voltage to the indoor-side relay 52. The outdoor unit 3 is provided on-board with an outdoor-side power-on circuit 60A3 for feeding a drive voltage to the outdoor-side relay 53.

The configuration and state of connection of the indoor-side power-on circuit 60A2 are the same as those of the power-on circuit 60A shown in FIG. 1.

The configuration of the outdoor-side power-on circuit 60A3 is the same as that of the power-on circuit 60A shown in FIG. 1. However, the anodes of the diodes 61 are respectively connected to the communication lines of a fan operation command communication line SG1, a cooling operation command communication line SG2, a heating operation command communication line SG3, and an other operation command communication line SG4, which lines are connected to the outdoor-side microcomputer 33.

For example, when the temperature-control microcomputer 41 of the thermostat 40 turns ON the cooling operation relay 46, 24 V AC is applied to the cooling operation command communication line SG2.

At this time, both the indoor-side power-on circuit 60A2 and the outdoor-side power-on circuit 60A3 are fed 24 V AC via the cooling operation command communication line SG2, and a drive voltage is applied to the drive coils of the indoor-side relay 52 and the outdoor-side relay 53.

In this way, it is acceptable for the indoor-side relay 52 and the outdoor-side relay 53 to be respectively driven by separate power-on circuits.

(6-2) Second Modification

In one or more embodiments of the first example, the power-on circuit 60A is configured on the indoor-side control board 21, but an externally attached type could be adopted instead.

Figure 4:
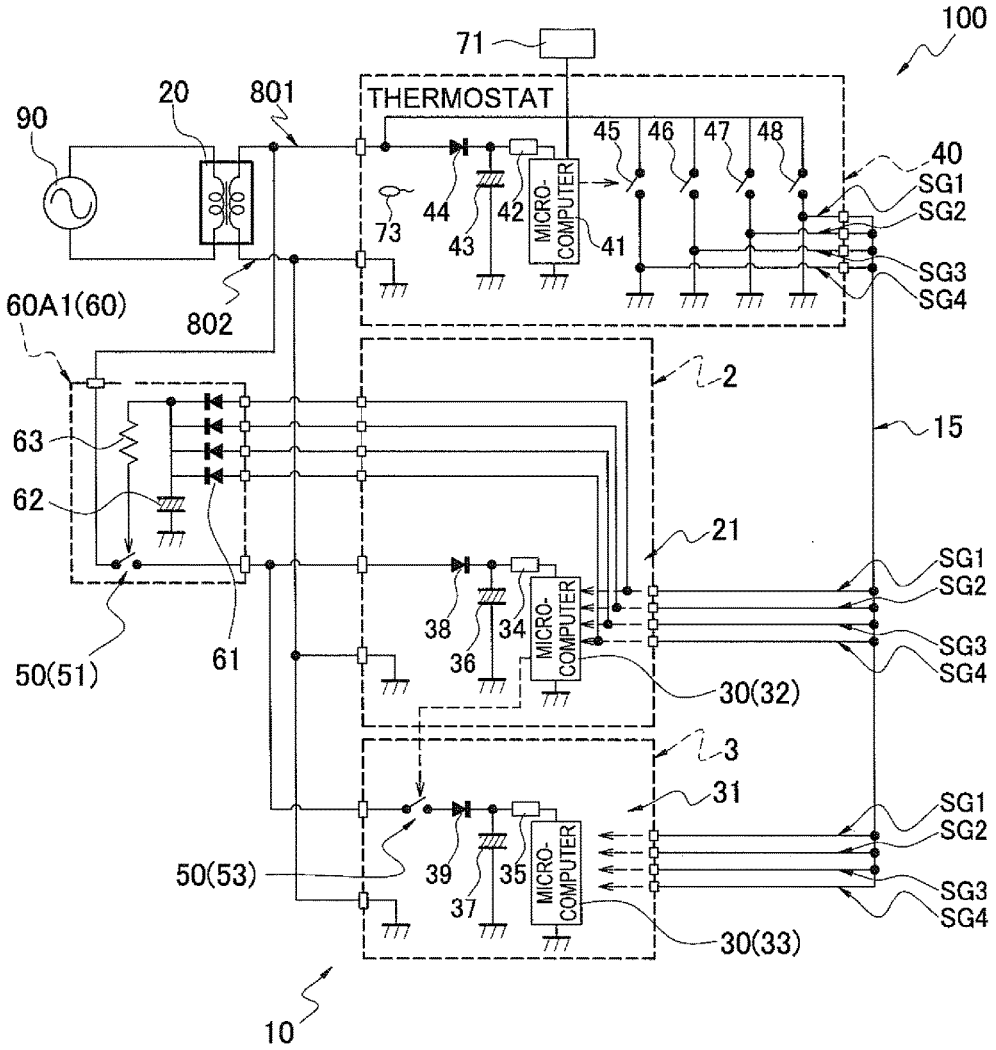
FIG. 4 is a block diagram showing a state of electrical connections of an air conditioner and a thermostat in an air conditioning system according to one or more embodiments of the present invention.

FIG. 4 is a block diagram showing a state of electrical connections of the air conditioner 10 and the thermostat 40 in an air conditioning system 100 according to one or more embodiments of the present invention. In FIG. 4, an externally attached power-on circuit 60A1 does not belong to either the indoor-side control board 21 or the outdoor-side control board 31. Herein, "externally attached" means that the externally attached power-on circuit 60A1 is disposed between the thermostat 40 and the air conditioner 10, and is a generic designation for types arranged adjacent to the indoor-side control board 21 or the outdoor-side control board 31, or types externally attached to the air conditioner 10.

Here, major differences between the configuration of the externally attached power-on circuit 60A1 and that in embodiments of the first example are described; in other aspects, the configuration is the same as embodiments of the first example, and description will be omitted.

(6-2-1) Configuration of Externally Attached Power-on Circuit 60A1

The externally attached power-on circuit 60A1 is a circuit for driving a relay that feeds power to the indoor-side microcomputer 32, and has an externally attached relay 51, a plurality of diodes 61, a capacitor 62, and a resistor element 63. The externally attached relay 51 has the same configuration as the indoor-side relay 52 in embodiments of the first example.

The quantity of the diodes 61 coincides with the quantity of the operation command communication lines connected to the indoor-side microcomputer 32, and the anode sides thereof are connected to any of the plurality of communication lines.

In the second modification, the anodes of the diodes 61 are respectively connected to the communication lines of the fan operation command communication line SG1, the cooling operation command communication line SG2, the heating operation command communication line SG3, and the other operation command communication line SG4.

The capacitor 62 is connected between ground GND and the cathodes of the diodes 61, in order to maintain and stabilize the potential at the cathodes of the diodes 61.

One lead of the resistor element 63 is connected to the cathodes of the diodes 61, and the other lead is connected to a drive coil (not illustrated) of the indoor-side relay 52. The resistor element 63 lowers the applied voltage to a voltage suitable for driving the indoor-side relay 52, and feeds the voltage to the externally attached relay 51.

(6-2-2) Action of Air Conditioning System 100 According to Second Modification The description here takes the example of a cooling operation. For example, when the temperature-control microcomputer 41 of the thermostat 40 turns ON the cooling operation relay 46, 24 V AC is applied to the cooling operation command communication line SG2. At this time, the 24 V AC is fed, via the cooling operation command communication line SG2, to the externally attached power-on circuit 60A1 as well, and a drive voltage is fed to the drive coil of the externally attached relay 51.

Due to the externally attached relay 51 turning ON, the power fed from the transformer 20 is fed to the indoor-side switching power supply 34, and the indoor-side microcomputer 32 starts up.

The indoor-side microcomputer 32 then feeds a drive voltage to the drive coil of the outdoor-side relay 53, turning ON the outdoor-side relay 53.

Due to the outdoor-side relay 53 turning ON, the power fed from the transformer 20 is fed to the outdoor-side switching power supply 35, and the outdoor-side microcomputer 33 starts up.

The cooling operation of the air conditioner 10 is carried out while the indoor-side microcomputer 32 and the outdoor-side microcomputer 33 exchange communication with one another.

(6-2-3) Effect of Second Modification

With the air conditioning system 100, by incorporating the externally attached relay 51 into the externally attached power-on circuit 60A1, it is possible for the externally attached power-on circuit 60A1 to be externally attached with substantially no modification, even to an air conditioner that cannot be adapted to reduced power consumption during standby, and the unit can be converted to a reduced standby power specification in a simple manner.

(6-3) Third Modification

Figure 5:
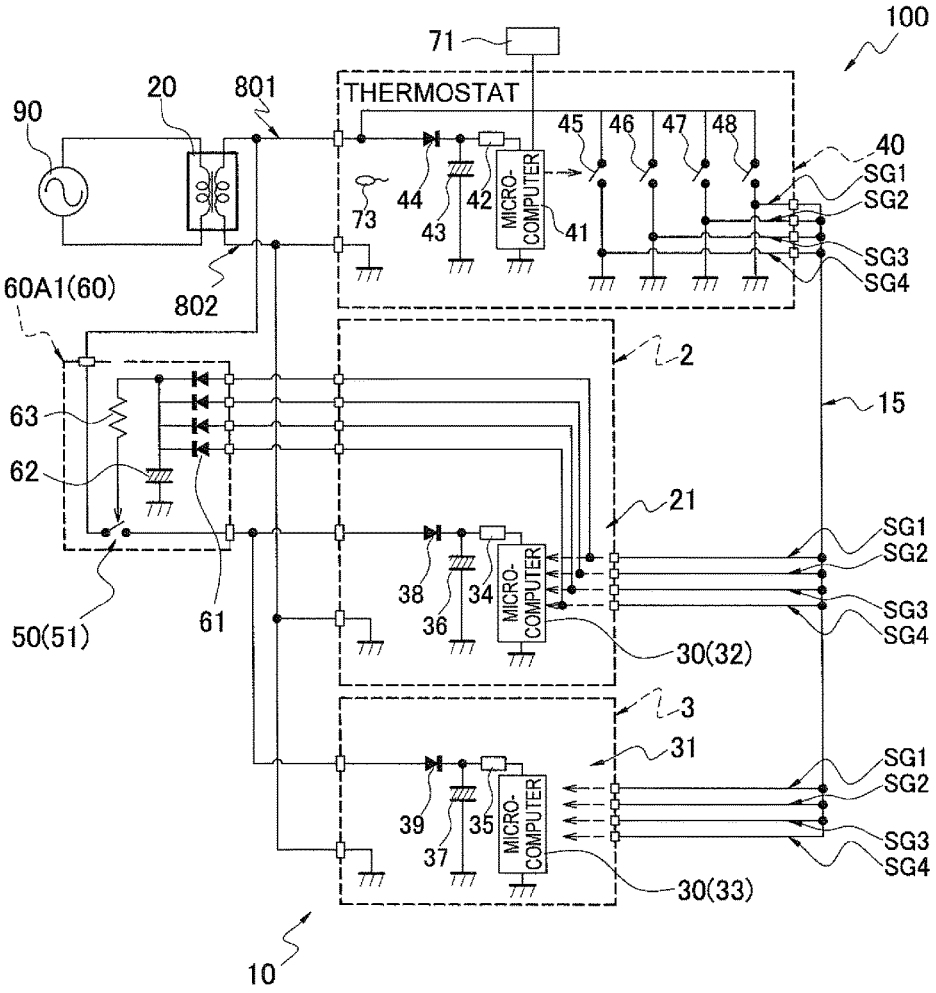
FIG. 5 is a block diagram showing a state of electrical connections of an air conditioner and a thermostat in an air conditioning system according to one or more embodiments of the present invention.

FIG. 5 is a block diagram showing a state of electrical connections of the air conditioner 10 and the thermostat 40 in an air conditioning system 100 according to one or more embodiments of the present invention. The air conditioning system according to the embodiments in FIG. 5, in contrast to the air conditioning system 100 according to the embodiments in FIG. 4, dispenses with the outdoor-side relay 53 on the outdoor-side control board 31, instead furnishing wiring that connects the externally attached relay 51 and the outdoor-side switching power supply 35, so that power is fed from the externally attached relay 51 of the externally attached power-on circuit 60A1; the two systems differ in this respect.

Consequently, the outdoor-side microcomputer 33 does not start up after the indoor-side microcomputer 32 starts up as in the second modification; instead, power is fed to both the indoor-side switching power supply 34 and the outdoor-side switching power supply 35 at the same time that the externally attached relay 51 turns ON, and the outdoor-side microcomputer 33 and the indoor-side microcomputer 32 start up at the same time.

As a result, power can be fed to both the indoor-side microcomputer 32 and the outdoor-side microcomputer 33 by the single externally attached relay 51, and costs are low.

Second Example (1) Overview of Air Conditioning System 200

Figure 6:
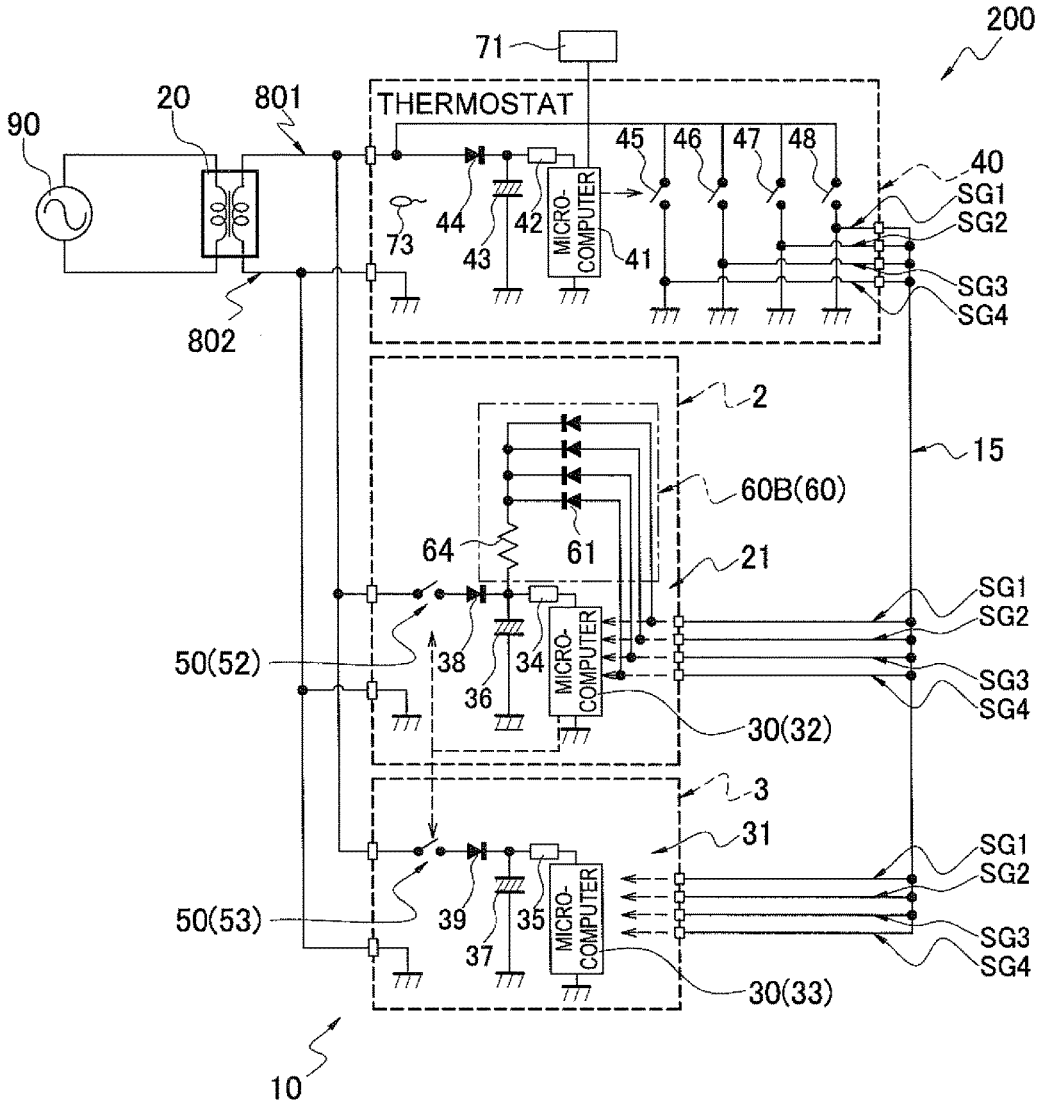
FIG. 6 is a block diagram showing a state of electrical connections of an air conditioner and a thermostat in an air conditioning system according to one or more embodiments of the present invention.

FIG. 6 is a block diagram showing a state of electrical connections of an air conditioner 10 and a thermostat 40 in an air conditioning system 200 according to one or more embodiments of the second example of the present invention. In FIG. 6, the thermostat 40 is identical to the thermostat of embodiments of the first example. The configuration of the air conditioner 10, apart from the power-on circuit 60B, is the same as that of embodiments of the first example. Therefore, in the second example, only the configuration of the power-on circuit 60B will be described.

(2) Power-on Circuit 60B

In the embodiments of the first example shown above, the power-on circuit 60A is a circuit for direct driving of the indoor-side relay 52; in embodiments of the second example, however, the power-on circuit 60B is a circuit for directly starting up the indoor-side microcomputer 32.

As shown in FIG. 6, the power-on circuit 60B has a plurality of diodes 61, and a resistor element 64. The quantity of the diodes 61 coincides with the quantity of the operation command communication lines connected to the indoor-side microcomputer 32, and the anode sides thereof are connected to any of the plurality of communication lines.

In the present embodiment, the anodes of the diodes 61 are respectively connected to the communication lines of the fan operation command communication line SG1, the cooling operation command communication line SG2, the heating operation command communication line SG3, and the other operation command communication line SG4.

One lead of the resistor element 64 is connected to the cathodes of the diodes 61, and the other lead is connected to the indoor-side switching power supply 34. The resistor element 64 limits the current flowing into the indoor-side capacitor 36, in consideration of the allowable current at the thermostat 40 side.

(3) Action of Air Conditioning System 200

The action of the air conditioning system 200, in terms of the flow chart, is identical to the control flow of the embodiments of the first example depicted in FIG. 2A, FIG. 2B, and FIG. 2C. A difference is that whereas in the embodiments of the first example, the action is one whereby the indoor-side microcomputer 32 starts up after the indoor-side relay 52 is driven, in the embodiments of the second example, the indoor-side relay 52 is driven after the indoor-side microcomputer 32 starts up. A cooling operation is described below by way of example.

For example, when the temperature-control microcomputer 41 of the thermostat 40 turns ON the cooling operation relay 46, 24 V AC is applied to the cooling operation command communication line SG2. At this time, 24 V AC is also fed to the power-on circuit 60B via the cooling operation command communication line SG2.

The 24 V AC fed to the power-on circuit 60B charges the indoor-side capacitor 36, via the diodes 61 and the resistor element 64. The indoor-side switching power supply 34 converts a voltage, applied by the charged indoor-side capacitor 36, to a control voltage, which is fed to the indoor-side microcomputer 32, and starts up the indoor-side microcomputer 32.

The started-up indoor-side microcomputer 32 feeds a drive voltage to the drive coil of the indoor-side relay 52, turns ON the indoor-side relay 52, and stably feeds power to the indoor-side switching power supply 34 from the transformer 20.

The indoor-side microcomputer 32 additionally feeds a drive voltage to the drive coil of the outdoor-side relay 53, and turns ON the outdoor-side relay 53. Due to the outdoor-side relay 53 turning ON, power is stably fed to the outdoor-side switching power supply 35 from the transformer 20, and the outdoor-side microcomputer 33 starts up.

Subsequently, the cooling operation of the air conditioner 10 is carried out while the indoor-side microcomputer 32 and the outdoor-side microcomputer 33 exchange communication with one another.

(4) Characteristics of Second Example (4-1)

In the air conditioning system 200, even in a state in which the feed of power to the indoor-side microcomputer 32 and the outdoor-side microcomputer 33 has been stopped, the power-on circuit 60B, utilizing the voltage of the control signal inputted to the indoor-side microcomputer 32 of the thermostat 40, starts up the indoor-side microcomputer 32, the started up indoor-side microcomputer 32 drives the indoor-side relay 52 and the outdoor-side relay 53, and subsequently power is stably fed to the indoor-side microcomputer 32 and the outdoor-side microcomputer 33. As a result, the feed of power to the indoor unit 2 and the outdoor unit 3 can be stopped during standby, and the power consumed by the air conditioner during standby can be kept to a minimum, as compared to a system of conventional type.

(4-2)

In the air conditioning system 200, the power-on circuit 60B has the plurality of diodes 61, and the resistor element 64. The power (24 V AC) fed from the thermostat 40 charges the indoor-side capacitor 36 via the diodes 61 and the resistor element 63. A voltage of the charged indoor-side capacitor 36 is applied to the indoor-side switching power supply 34, and the indoor-side microcomputer 32 starts up. Therefore, the circuit configuration of the power-on circuit 60B is simple, and the indoor-side microcomputer 32 can perform drive control of the indoor-side relay 52 and the outdoor-side relay 53 independently.

(5) Modifications

A number of various modes may be provided by way of the basic form of the power-on circuit 60B in the embodiments of the second example, by varying the quantity or arrangement thereof.

(5-1) First Modification

In the embodiments of the second example, after the indoor-side microcomputer 32 is started up by the power-on circuit 60B, the outdoor-side relay 53 is driven by the indoor-side microcomputer 32, and the outdoor-side microcomputer 33 is started up; however, it would also be acceptable for the indoor-side relay 32 and the outdoor-side relay 33 to be respectively started up by separate power-on circuits.

Figure 7:
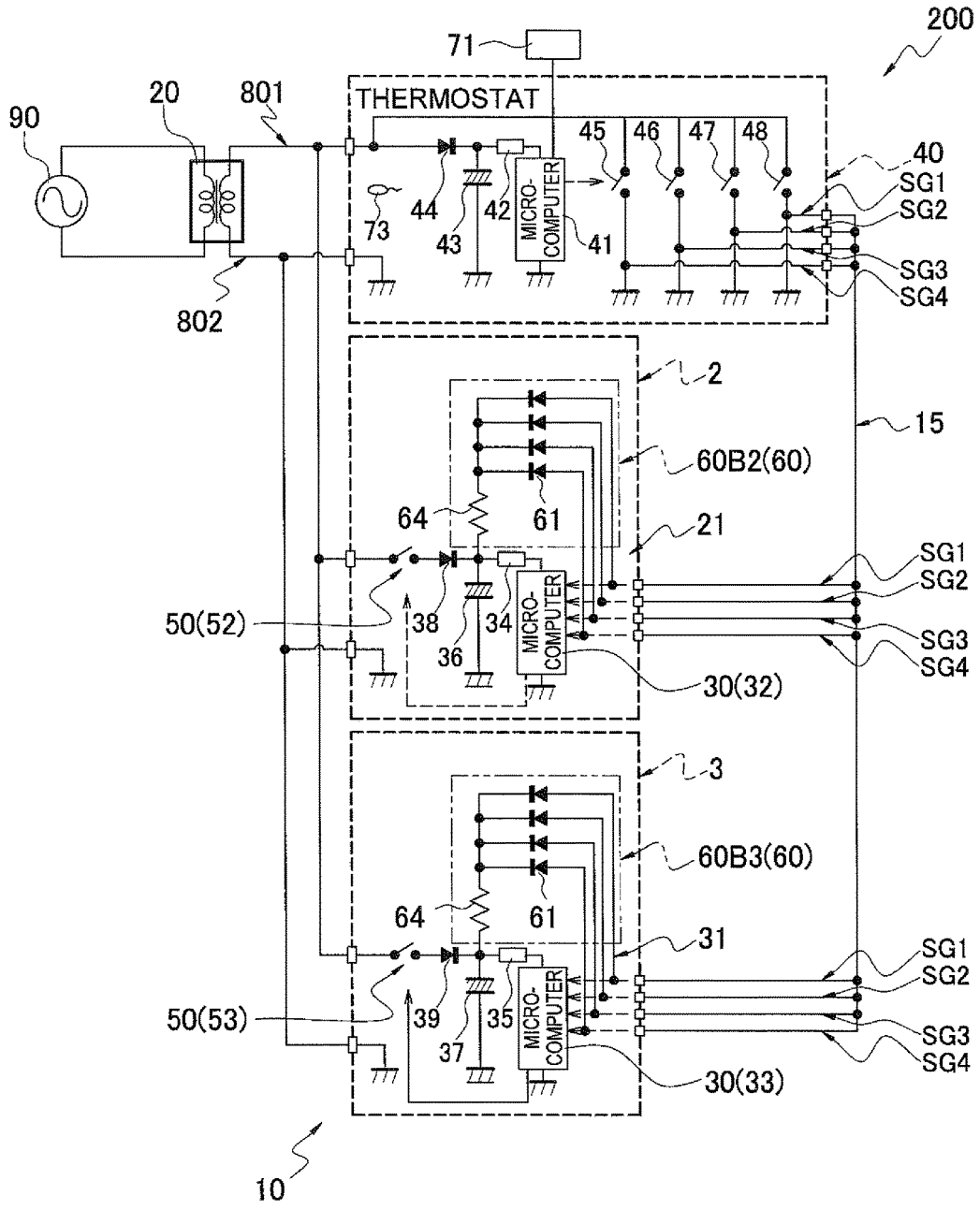
FIG. 7 is a block diagram showing a state of electrical connections of an air conditioner and a thermostat in an air conditioning system according to one or more embodiments of the present invention.

FIG. 7 is a block diagram showing a state of electrical connections of the air conditioner 10 and the thermostat 40 in an air conditioning system 200 according to one or more embodiments of the present invention. In FIG. 7, the indoor unit 2 is provided on-board with an indoor-side power-on circuit 60B2 for starting up the indoor-side microcomputer 32. The outdoor unit 3 is provided on-board with an outdoor-side power-on circuit 60B3 for starting up the outdoor-side microcomputer 33.

The configuration and state of connection of the indoor-side power-on circuit 60B2 are the same as those of the power-on circuit 60B shown in FIG. 6.

The configuration of the outdoor-side power-on circuit 60B3 is identical to that of the power-on circuit 60B shown in FIG. 6. However, the anodes of the diodes 61 are respectively connected to the communication lines of a fan operation command communication line SG1, a cooling operation command communication line SG2, a heating operation command communication line SG3, and an other operation command communication line SG4, which lines are connected to the outdoor-side microcomputer 33.

For example, when the temperature-control microcomputer 41 of the thermostat 40 turns ON the cooling operation relay 46, 24 V AC is applied to the cooling operation command communication line SG2.

At this time, both the indoor-side power-on circuit 60B2 and the outdoor-side power-on circuit 60B3 are fed 24 V AC via the cooling operation command communication line SG2, and the indoor-side microcomputer 32 and the outdoor-side microcomputer 33 start up.

In this way, it is acceptable for the indoor-side microcomputer 32 and the outdoor-side microcomputer 33 to be respectively started up by separate power-on circuits.

(5-2) Second Modification

In the embodiments of the second example, the power-on circuit 60B is configured on the indoor-side control board 21, but an indoor-side control board 21 externally attached type could be adopted instead.

Figure 8:
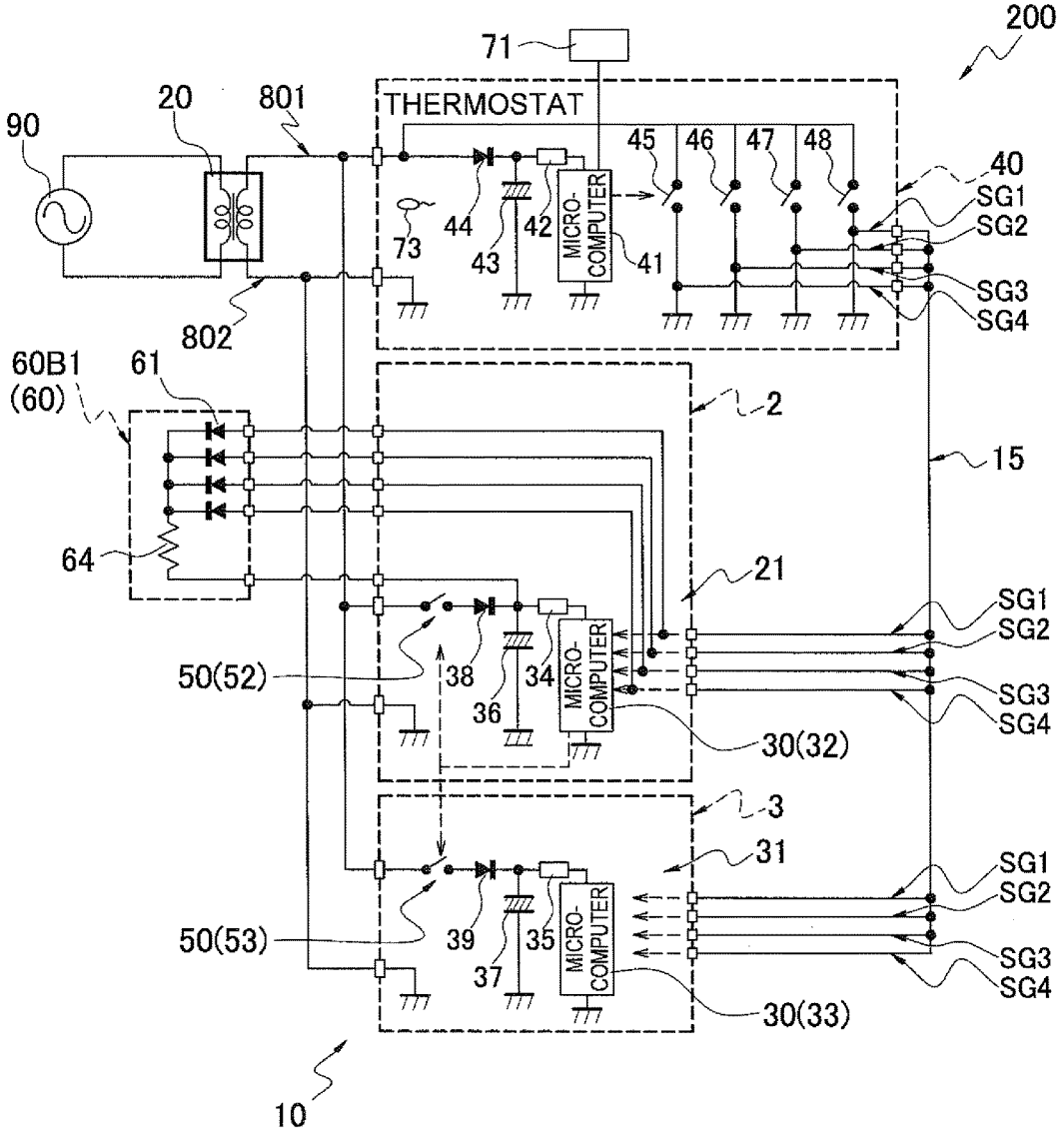
FIG. 8 is a block diagram showing a state of electrical connections of an air conditioner and a thermostat in an air conditioning system according to one or more embodiments of the present invention.

FIG. 8 is a block diagram showing a state of electrical connections of the air conditioner 10 and the thermostat 40 in an air conditioning system 200 according to one or more embodiments of the present invention. In FIG. 8, an externally attached power-on circuit 60B 1 does not belong to either the indoor-side control board 21 or the outdoor-side control board 31. Herein, "externally attached type" means that the externally attached power-on circuit 60B 1 is disposed between the thermostat 40 and the air conditioner 10, and is a generic designation for types arranged adjacent to the indoor-side control board 21 or the outdoor-side control board 31, or types externally attached to the air conditioner 10.

The configuration of the externally attached power-on circuit 60B 1 is identical to that of the power-on circuit 60B of embodiments of the second example, and the action of the air conditioning system 200 is also identical to that in embodiments of the second example.

During a cooling operation for example, when the temperature-control microcomputer 41 of the thermostat 40 turns ON the cooling operation relay 46, 24 V AC is applied to the cooling operation command communication line SG2. At this time, 24 V AC is applied to the externally attached power-on circuit 60B 1 as well, via the cooling operation command communication line SG2.

The 24 V AC fed to the externally attached power-on circuit 60B 1 charges the indoor-side capacitor 36 via the diodes 61 and the resistor element 64. The indoor-side switching power supply 34 converts the voltage applied by the charged indoor-side capacitor 36 to a control voltage, which is fed to the indoor-side microcomputer 32, starting up the indoor-side microcomputer 32.

The started-up indoor-side microcomputer 32 feeds a drive voltage to the drive coil of the indoor-side relay 52 and turns ON the indoor-side relay 52, and power is stably fed to the indoor-side switching power supply 34 from the transformer 40.

The indoor-side microcomputer 32 feeds a drive voltage to the drive coil of the outdoor-side relay 53 as well, and turns ON the outdoor-side relay 53. Due to the outdoor-side relay 53 turning ON, power is stably fed to the outdoor-side switching power supply 35 from the transformer 20, and the outdoor-side microcomputer 33 starts up.

Subsequently, the cooling operation of the air conditioner 10 is carried out while the indoor-side microcomputer 32 and the outdoor-side microcomputer 33 exchange communication with one another.

(5-3) Third Modification

Figure 9:
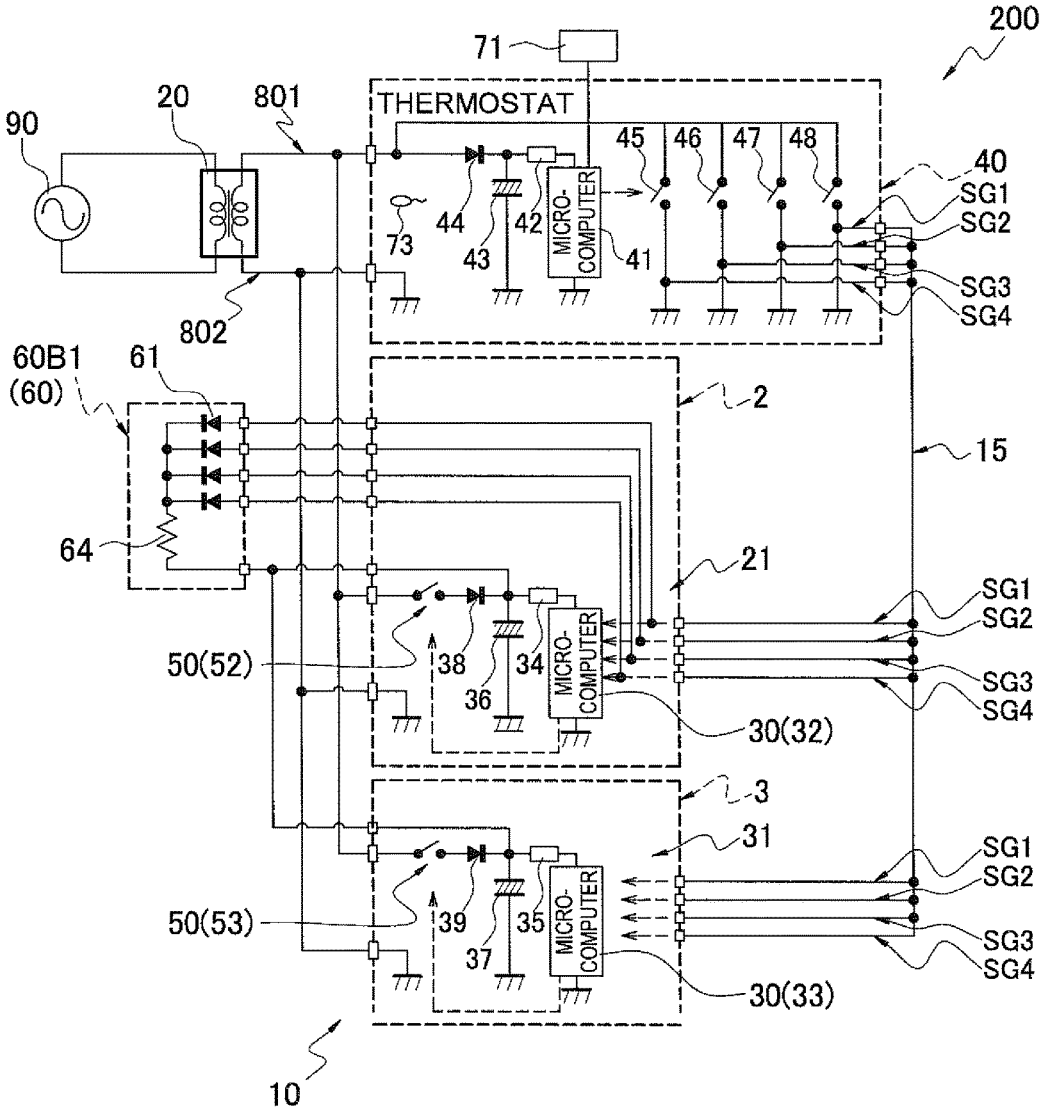
FIG. 9 is a block diagram showing a state of electrical connections of an air conditioner and a thermostat in an air conditioning system according to one or more embodiments of the present invention.

FIG. 9 is a block diagram showing a state of electrical connections of the air conditioner 10 and the thermostat 40 in an air conditioning system 200 according to one or more embodiments of the present invention. The air conditioning system according to one or more embodiments of the present invention in FIG. 9 is furnished with wiring connecting the externally attached power-on circuit 60B 1 and the high-potential side of the indoor-side capacitor 36 and wiring connecting the externally attached power-on circuit 60B 1 and the high-potential side of the outdoor-side capacitor 37, so that power is fed from the externally attached power-on circuit 60B 1, and in this respect differs from the air conditioning system 200 according to embodiments of the second example in FIG. 8

Consequently, rather than starting up the indoor-side microcomputer 32 and thereafter starting up the outdoor-side microcomputer 33 as in embodiments of the second example, power is fed to both the indoor-side switching power supply 34 and the outdoor-side switching power supply 35, and the indoor-side microcomputer 32 and the outdoor-side microcomputer 33 start up at the same time.

INDUSTRIAL APPLICABILITY

According to the invention of the present application as shown above, even in a state in which the feed of power to respective microcomputers of an indoor unit and an outdoor unit is stopped, the microcomputers can be started up by the voltage of a control signal from a thermostat, and therefore the invention is not limited to separate type air conditioners, and can be widely utilized in air conditioners that are controlled by a control signal from a thermostat.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2 Indoor unit (utilization-side unit)
3 Outdoor unit (heat source-side unit)
10 Air conditioner
30 Microcomputer
32 Indoor-side microcomputer
33 Outdoor-side microcomputer
40 Thermostat
50 Relay
51 Externally attached relay

52 Indoor-side relay
53 Outdoor-side relay
60 Power-on circuit
60A Power-on circuit
60B Power-on circuit
60A1 Externally attached power-on circuit
60B1 Externally attached power-on circuit
60A2 Indoor-side power-on circuit
60B2 Indoor-side power-on circuit
60A3 Outdoor-side power-on circuit
60B3 Outdoor-side power-on circuit
61 Diode
62 Capacitor
64 Resistor element
100 Air conditioning system
200 Air conditioning system

CITATION LIST

Patent Literature

PTL 1: Japanese Laid-open Patent Application No. 2000-111123

The invention claimed is:

1. An air conditioning system, comprising:
a microcomputer that controls a utilization-side unit and a heat source-side unit of an air conditioner;
a thermostat connected to the air conditioner,
wherein the thermostat switches, according to a measured temperature, between an ON state in which the thermostat inputs a control signal to the microcomputer and an OFF state in which the thermostat does not input the control signal to the microcomputer;
a relay that switches to either a power feed state in which power is fed to the microcomputer or a power non-feed state in which power is not fed to the microcomputer; and
a power-on circuit housed within or externally attached to the air conditioner,
wherein the power-on circuit switches the relay from the power non-feed state to the power feed state using a voltage of the control signal inputted to the microcomputer.

2. The air conditioning system according to claim 1, wherein the power-on circuit directly drives the relay using the voltage of the control signal inputted to the microcomputer.

3. The air conditioning system according to claim 1, wherein the power-on circuit starts up the microcomputer using the voltage of the control signal inputted to the microcomputer, and drives the relay via the microcomputer.

4. The air conditioning system according to claim 1, wherein the power-on circuit is externally disposed between the thermostat and the air conditioner.

5. The air conditioning system according to claim 1, wherein
the relay is connected to a power line of the microcomputer,
the power-on circuit comprises:
diodes whose anodes are connected to lines over which the control signal is communicated; and
a capacitor, wherein one lead of the capacitor is connected to cathodes of the diodes, and the other lead of the capacitor is connected to ground, and
a potential of the capacitor is used as drive voltage for the relay.

6. The air conditioning system according to claim 5, wherein the relay is incorporated into the power-on circuit.

7. The air conditioning system according to claim 1, wherein
the relay is connected to a power line of the microcomputer, and
the power-on circuit comprises:
diodes whose anodes are connected to lines over which the control signal is communicated; and
a resistor element between the relay and the microcomputer, wherein one lead of the resistor element is connected to cathodes of the diodes, and the other lead of the resistor element is connected to the power line.

8. The air conditioning system according to claim 2, wherein the power-on circuit is externally disposed between the thermostat and the air conditioner.

9. The air conditioning system according to claim 3, wherein the power-on circuit is externally disposed between the thermostat and the air conditioner.

10. The air conditioning system according to claim 2, wherein
the relay is connected to a power line of the microcomputer,
the power-on circuit comprises:
diodes whose anodes are connected to lines over which the control signal is communicated; and
a capacitor, wherein one lead of the capacitor is connected to cathodes of the diodes, and the other lead of the capacitor is connected to ground, and
a potential of the capacitor is used as drive voltage for the relay.

11. The air conditioning system according to claim 3, wherein
the relay is connected to a power line of the microcomputer, and
the power-on circuit comprises:
diodes whose anodes are connected to lines over which the control signal is communicated; and
a resistor element between the relay and the microcomputer, wherein one lead of the resistor element is connected to cathodes of the diodes, and the other lead of the resistor element is connected to the power line.

12. The air conditioning system according to claim 1, wherein
the microcomputer comprises a first microcomputer that controls the utilization-side unit and second microcomputer that controls the heat source-side unit.

13. An air conditioning system, comprising:
a utilization-side unit comprising a first microcomputer that controls the utilization-side unit;
a heat source-side unit comprising a second microcomputer that controls the heat source-side unit;
a thermostat connected to the utilization-side unit and heat source-side unit,
wherein the thermostat switches, according to a measured temperature, between an ON state in which the thermostat inputs a control signal to both the first and the second microcomputer and an OFF state in which the thermostat does not input the control signal to either the first or the second microcomputer;
a relay that switches to either a power feed state in which power is fed to at least one of the first and the second microcomputer or a power non-feed state in which power is not fed to either the first or the second microcomputer; and a power-on circuit housed within or externally attached to one of the utilization-side unit or heat source-side unit, wherein the power-on circuit switches the relay from the power non-feed state to the power feed state using a voltage of the control signal inputted to the one of the first or second microcomputer.

* * * * *